US006744998B2

(12) United States Patent
McIntyre

(10) Patent No.: US 6,744,998 B2
(45) Date of Patent: Jun. 1, 2004

(54) PRINTER WITH VIDEO PLAYBACK USER INTERFACE

(75) Inventor: C. Kevin McIntyre, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/252,933

(22) Filed: Sep. 23, 2002

(65) Prior Publication Data

US 2004/0057743 A1 Mar. 25, 2004

(51) Int. Cl.[7] ..... G03G 15/00; G03G 21/00
(52) U.S. Cl. ..... 399/81; 399/8; 399/11
(58) Field of Search ..... 399/8, 9, 81, 11, 399/18, 19, 21, 23, 24, 82, 107, 110, 124; 358/1.14, 1.15

(56) References Cited

U.S. PATENT DOCUMENTS 4,682,158 A * 7/1987 Ito et al. ..... 399/81 X
6,133,844 A 10/2000 Ahne et al.
6,185,379 B1 2/2001 Lay et al.
6,304,732 B1 * 10/2001 Myers et al. ..... 399/81
6,314,249 B1 11/2001 Lay et al.
6,400,462 B1 6/2002 Hille
6,601,159 B1 * 7/2003 Smith et al. ..... 399/11 X

* cited by examiner

*Primary Examiner*—Sophia S. Chen

(57) ABSTRACT

A network or local printer has a video demonstration mode, preferably using a control console of the printer to display steps to be performed by a human user, by producing a video presentation. A stored selection of video clips is stored or made available, each demonstrating an operation being performed on an exemplary printer that resembles the particular printer apparatus. A video clip processor selects among the video clips and/or controls the manner of playback, based on sensed conditions and/or user input to assist the human user in performing the operation, without boring experienced users or overloading inexperienced ones with unneeded information.

21 Claims, 2 Drawing Sheets

PRINTER WITH VIDEO PLAYBACK USER INTERFACE

FIELD OF THE INVENTION

The invention relates to the field of printers.

BACKGROUND OF THE INVENTION

Various devices that incorporate data processors or are coupled to data processing networks require a users active participation in connection with operations. The extent of required participation differs, depending on the type of device. In connection with printing devices such as laser printers, color printers, photocopiers, facsimile machines and combination devices with print capabilities, the user's participation may involve relatively complex operations.

One type of operation involves setup procedures. These can include setting various default conditions, selecting options for a particular job such as paper size or orientation, color calibration steps, entering source or destination information, and various other selections. A different kind of operation that advantageously relies on actions by the user may involve diagnostic and fault recovery procedures, namely identifying, isolating and correcting operational problems, a familiar example being the clearing of paper jams. A third type of operation may concern regular maintenance procedures such as changing supplies of toner or other pigment, cleaning print heads and paper paths, etc.

For high volume and/or high speed printers and other devices, the extent of user involvement is higher than for less capable devices because there are more options, e.g., for selection of media size or orientation, collating of multiple copy output and the like. There are also more potential trouble spots, because each added choice or capability is likely to have one or more associated actuators, switches, alternative paper paths or other element that may occasionally cause a fault condition or need service. There are also other complications, such as the possible fitting out of such devices with options that may need to be installed or debugged in a relatively unique or customized way. Sometimes such unique aspects include third party or aftermarket additions, which might be supplied by parties other than the original manufacture.

High capacity printers, photocopiers and multipurpose sheet and image processing devices typically have a cabinet with access doors, removable drawers or cartridges, and a user interface display device of some kind. The doors and drawers, and other movable parts, often have associated limit switches or photodetector source/detector pairs for providing a signal to a controller to sense and indicate their states and/or positions. Strategic points along one or more paper paths may have similar sensors for monitoring the progress of a job involving movement of paper, paper feeders, printing heads or other movable elements. A controller coupled to such switches and sensors infers information about the apparatus, and may signal an alert in the event of various conditions. Such an alert could point out an impending condition such as "toner supply low," or a condition likely to prevent proper operation such as "paper cartridge not loaded" or may indicate the occurrence of a fault such as "paper jam." Such apparatus can be sophisticated about detecting the nature of such problems and in signaling to the attendant where the problem lies.

The printer controller provides triggering signals to activate actuators, and monitors operations based on the sensor signals, according to a stored program. The program is affected by the respective sensors and also by the dictates of inputs such as user-operated switches or stored data or data received from an eternally-coupled processor, network or other data source. Before commencing a print operation, the controller might sense the state or position of the printer's doors or functional parts, the presence of paper cartridges or paper therein, and otherwise determine whether the printer is in condition for operation. If the printer is not ready, an alarm or other message signals the user and points out the deficiency (e.g., paper supply empty or cabinet door open, etc.).

During a print operation, the controller might sense the progress of the paper along a feed path that is expected based upon the activation of various actuators that are intended to feed paper along a predetermined path when operating properly. The controller senses for the progress of the print medium according to a programmed sequence of expected paper positions and perhaps expected time delays, based on the controller's signals for effecting paper feed and other similar printing operations. Even if a print operation was commenced normally, the apparent failure of the print medium (e.g., a sheet of paper) to progress from one expected position to a next expected position within a given time, may be sensed and caused to trigger an alarm or other message signal. Additionally, operation of the printer may be suspended until some action is detected that is expected and necessary according to the controller program, such as opening and closing a cabinet door or removing a piece of paper from some position at which it is considered jammed.

Sensed deficiencies in initial condition, and operational faults during printer operation, advantageously generate an alarm and also present sufficient information on the nature and location of the fault to enable the attendant to identify and correct many types of faults. Several techniques are used to identify the location of a fault. For example, warning lamps may be mounted at selected positions on the apparatus, including at paper path positions normally concealed behind cabinet doors. The lamps are illuminated by the controller to indicate to a user that attention is needed at that particular location, e.g., along a feed path or so as to maintain a nearby element of the printer.

Similar location-identifying warnings can be displayed physically apart from the printer mechanism on an analogous diagram or the like. For example, a light emitting diode (LED) or liquid crystal display (LCD) panel on some apparatus depicts an outline of all or part of the printer, such as the access doors and/or the paper feed path, with controllable light emitters, blinking LCD display lines or the like to show the area that needs attention.

Diagnostic displays as described tend to alert the attendant and can help to localize problems. The displays can have some specific instructions involved, for example blinking or animating the opening of a panel or door in the area of a jam to be cleared. However, such displays have a predetermined and fixed level of detail. The display normally does not expound on the nature of a problem. For users that have never encountered a particular problem before and thus lack any frame of reference, a diagrammatic display may be inadequate. A textual display also may fail to instruct the user sufficiently to enable correction of the problem because it assumes that the user knows certain minimal things such as the location of the access doors. More complex displays are possible, for example with blinking diagrams, text and other aspects, but this also can be baffling to an inexperienced user.

On the other hand, an experienced user may find detailed information to be annoying. Simple warnings and displays are most helpful to experienced users, who have previously encountered a problem in the identified location and have an idea about how to deal with it. It would be advantageous to provide a form of warning and instruction that is apt for users of a wide range of experience levels. That is, warning and instruction techniques need to be rich in detail for novices and at the same time should permit an experienced user to quickly and efficiently proceed to correction of a given condition.

Photocopy machines and similar print devices are known with relatively extensive LCD displays of text and diagrams. Such a display that includes sensed condition display elements and extensive diagnostic text descriptions and instructions is disclosed in U.S. Pat. Nos. 6,314,249 and 6,185,379—Lay et al. These text descriptions and instructions are helpful but require some knowledge of the structure of the printer and some feel for the terminology. Also, the descriptions may be more information than the user wants or needs, which can be tedious.

In U.S. Pat. No. 6,400,462—Hille, a printer is serviced using information and programming contained in an external device. This can provide the capability to address for very specific error conditions, and at times to localize problems to a particular element that is not functioning properly and needs to be adjusted, repaired or replaced. A control panel such as a 128×64 pixel LCD panel is provided on the printer and provides an interface for usual printing operations. The printer is coupleable to a programmed printer service tool that resembles a laptop computer. The tool is coupled in data communication with the printer controller and enables more sophisticated diagnostic techniques than the printer controller is programmed to handle on its own.

According to the technique in Hille, a printer controller could report to the service tool a code or bit string that reveals the state of the printer sensors. The controller might also provide associated information, for example, defining not only the printer model but also reporting all the specific optional parts that are installed. The controller can also report all the options and default settings that it may have stored in memory, and can even report a log of sensed conditions over time. All this information can be made available to the program of the service tool. The information assists in diagnosing the nature of the difficulty and determining necessary action to correct problems.

The Hille service tool has a plurality of locally stored hypertext markup language pages and operates an html browser to assist a human user in selecting information files that relate to codes read from the printer controller, or other information concerning the printer. Apart from the stored pages, which presumably are relatively verbose, the service tool displays abbreviated codes that represent status reports as to certain optional modes and/or modules. In the disclosed embodiment, the service tool has indicators for at least some printer modes (e.g., "manual" mode is indicated by a display code "MNL" and the presence of a printer cartridge is indicated by "CSNS").

The service tool also has indicators to report that certain signals are found to be presents (e.g., "HVAC" represents the presence of a high voltage signal and "DPLX" reports that the printer is in duplex mode, i.e., on-line). The technician uses the tool to produce a set of informational codes and status indicators that explain the printer's operational condition, and/or references stored html information pages and links based on the error codes that are reported.

Ideally, the Hille service tool stores in its local memory one or more linked html pages explaining the nature of each possible error code and describing in detail how to correct the problem(s) encountered. The disclosed service tool also can be connected to the Internet periodically to download from the manufacturer any new information or upgrades that may become available. This information is potentially extensive. By permitting the technician to drill through a series of linked html pages, it entails a selected level of detail. However the detail assumes substantial knowledge on the part of the technician. The information is substantially for the benefit of service calls and not for normal operational part of the printer, for example to clear paper jams or for help in finding out where and how to load paper or toner, etc.

In connection with certain widely distributed software products, help functions are included that contain demonstrations of where to find, and how to make, menu choices. An example is the animated paper-clip helper or wizard icon that can be invoked in certain Microsoft products such as MS Word. That software product offers context-based menu choices to the user. In certain instances, the software reacts to user selections by taking control and moving the cursor to demonstrate menu selections. This is a form of demonstration that might be used in the control interface of a printer or the like, but it falls short of demonstrating the sort of information that the user really needs, for example to load paper or to change a toner cartridge or to partially disassemble the paper feed mechanism so as to clear a paper jam at a sensed location, etc. This sort of information includes details that experienced users may not even think about, such as the location of the most routine things, such as access doors and handles, and which information is quite difficult to explain using diagrams and software icons.

An improved system for providing information to a user is desired.

SUMMARY OF THE INVENTION

A printer such as a network printer or a peripheral printer coupled to a processor with a video demonstration mode, preferably using a control console of the printer, displays selected digital video files from a store of selections. Advantageously, in addition to the capability to select and play back a selection, the printer also has the capacity to download or otherwise accept new selections, for example associated with upgrades, updates or specific customized program video files, which might be new offerings of the printer manufacturer, or selections provided by a different manufacturer of an after market add-on product. The printer can be a digital printer, copier, fax printer, or multipurpose device, having a mechanism for applying markings and a sheet handler, wherein at least certain operations require steps to be performed by a human user. The control console or another display or readout is provided, capable of reproducing a video presentation. A stored selection of video clips is stored or made available, each of the video clips containing a demonstration of an operation being performed on an exemplary printer that resembles said printer apparatus. Preferably, a video clip processor selects among the video clips and/or controls the manner of playback, based on sensed conditions and/or user input. This presentation of a demonstration assists the human user in performing the operation, without boring experienced users or overloading inexperienced ones with unneeded information.

The media clips (e.g., video clips) can be stored in a local memory or downloaded, either for updating or on demand. The clips can be provided in various forms and preferable are short compressed digital video files in a conventional format. Advantageously, many of the clips target normal operational functions such as adding toner or paper, changing a paper size or cartridge type, etc. Preferably, the clips also encompass directions for dealing with exigencies such as clearing paper jams. Some clips can be directed to very specific, unusual or abnormal conditions, failures and the like. It is particularly advantageous in the case of rarely needed clips to provide for the possibility of downloading them from a remote store or otherwise adding such clips to the selections available for display, e.g., by loading a compact disc (CD) drive or the like into the printer.

For example, in a relatively rare case such as where a user desires to add memory capacity to the printer, the memory media (e.g., circuit cards, Single In-Line Memory Modules (SIMMs), etc.) could be provided to the user together with media adapted for display of installation and debugging instructions. Thus the user can play back instructions on the printer as to how to effect and test the memory upgrade. Other examples of this use should be apparent as well.

The clips that are stored or provided can be solely visual, or solely audio, but preferably are a combination of video and audio tracks. In the case of audio and video, the tracks can both contain the video demonstration and sounds of an exemplary user demonstrating the subject matter of the clip. The tracks thus might include the sound of doors opening and parts snapping together, etc. The exemplary user can be recorded discussion what he or she is demonstrating or a voice-over track or background music or other material can be employed. Where the tracks contain speech, they can be provided in one or in several selectable languages. The tracks also can contain unrelated audio and video segments. All these combinations and options are generally described herein as the "media" that is stored or downloaded or otherwise made available for playback.

BRIEF DESCRIPTION OF THE DRAWINGS

The drawings depict certain exemplary embodiments, the same reference numbers being used throughout the figures to identify the same elements. In the drawings.

DETAILED DESCRIPTION OF THE INVENTION

Figure 1:
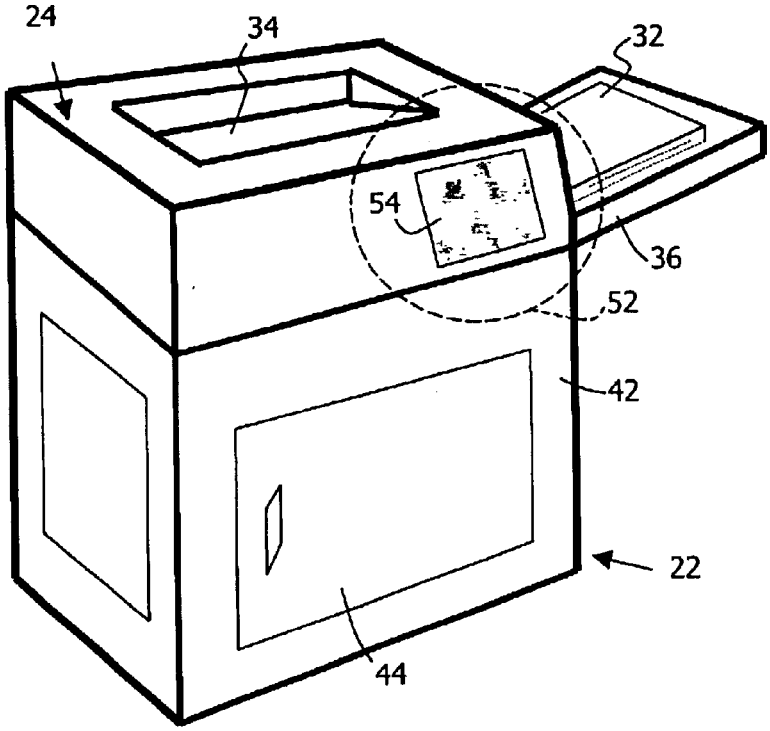
FIG. 1 is a schematic perspective illustration of a printer with a video playback control interface, according to an exemplary embodiment of the invention.
Figure 2:
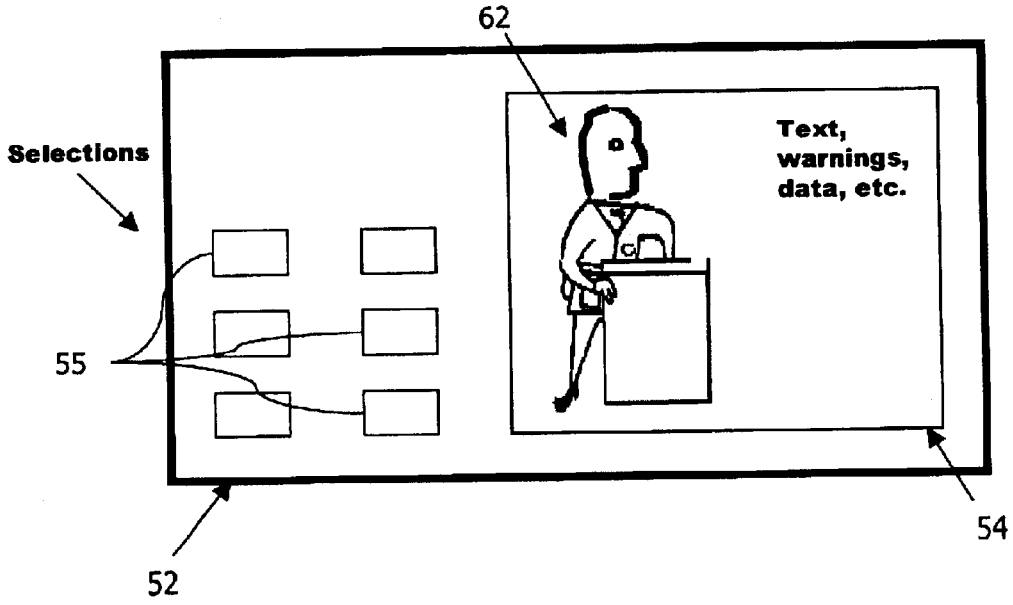
FIG. 2 is a detailed illustration of the display portion of the interface of FIG. 1, showing a demonstration clip in progress.

Referring to FIG. 1, a typical printer system 22 as shown has an associated printing mechanism 24 whereby markings are applied to sheet material 32. The printer can be any of various types of printers such as a laser printer, inkjet, standard sheet feed, large format, etc. In a preferred arrangement, the printer is part of a multipurpose input/output device that is coupled to a network (not shown in FIG. 1) and has various capabilities for printing from data, copying, scanning, transmitting facsimiles, etc. The exemplary apparatus shown has a manual sheet feed input 34 and an automatic sheet feed input 36, which generally illustrate sheet handling and feeding devices associated with the printer for moving the print media and applying markings via the printing mechanism 24.

The printing mechanism 24 is located substantially in a cabinet 42, where its operative elements are accessible to human user (not shown) by opening various doors and panels 44. At least certain operations that are needed to maintain and operate the apparatus require steps to be performed by the human user, who manipulates the printer apparatus 22, for example by loading the sheet feeders 34, 36, opening and closing the door panels 44 and otherwise moving and adjusting parts of the apparatus and the printing media that it processes, as necessary.

The printer system 22 has at least one control panel interface 52 for users. According to one inventive aspect, the control panel interface 52 has a visual display 54 that is arranged to reproduce and preferably to playback in motion, certain illustrations of users manipulating the printer apparatus 22. This facility enables users, such as novice users, to perform necessary or desirable operations without any substantial study or preparation as to how the printer is embodied or intended to operate. The same motion picture illustration facility optionally is useful for other purposes as well.

In a preferred arrangement, the apparatus presents selected moving picture displays 62 of video clips illustrating user operations. This is accomplished by playing back stored video or animated illustrations that are spooled from an associated storage device and/or are streamed or downloaded from a remote data source. Alternatively or additionally, other forms of media can be used.

The moving picture playback 62 is programmed or selected for presentation on visual display 54, on user demand and preferably also when the printer system 22 senses conditions that dictate that a particular operation could or should be performed, e.g., to enable an operation or to optimize some aspect of operation.

The playback can have selectable levels of detail, e.g., presenting different levels of detail and possibly also invoking different programmed operations of the printer control program, for a novice user versus a moderately-proficient user, a very experienced user, or even a maintenance technician. Moreover, a controller of the printer or a controller devoted to operation of the display (and perhaps other functions) can be programmed to decide on the level of detail needed, based upon sensed conditions and/or user selections via switch inputs 55. Thus the controller can be arranged to default to a summary clip with the programmed expectation that the summary will be sufficient, but to revert to a more detailed or more pedantic clip if the expected operation does commence promptly or does not proceed according to an expected sequence of user actions as detected by status detection inputs or inputs from user selection switches 55.

Another use for the capability to present detailed instructions is to facilitate instructions and documentation associated with relatively customized operations and user needs. Detailed instructions may be advantageous, for example, to permit a user to install and debug options such as add-ons, upgrades and other changes to the printing device after an initial sale. Such changes potentially could be supplied by parties other than the manufacturer of the basic device. Such third party supplier advantageously can supply instructional programming in a convenient form (video, audio or preferably audio-video) together with the add-on, or otherwise make it available to the user. In the case of third party or after-market add-ons, upgrades and the like, the video and/or audio program material can advantageously include additional pertinent information that might not already be available to the user, such as contact information for authorized repair shops, contact persons for other maintenance uses and information, etc., applicable to the add-on. In any case, the capability to add or download information in the form of demonstration programs and the like, is very useful where the subject matter involved is somewhat unique or unusual.

The display 54 also can be used, for example, periodically or by programming or user selection to display information that is not closely related to the presently-sensed status of the printer 22. Informational or entertaining clips, or even promotional banners, ads and offers, can be provided in stored clips and read out in much the same way as maintenance instruction information. A difference in such read-out is that the operational instructions can be queued based on sensed conditions and user selections, whereas clips unrelated to operation can be queued for other reasons, e.g., periodically or randomly or based on external signaling instructions.

Figure 3:
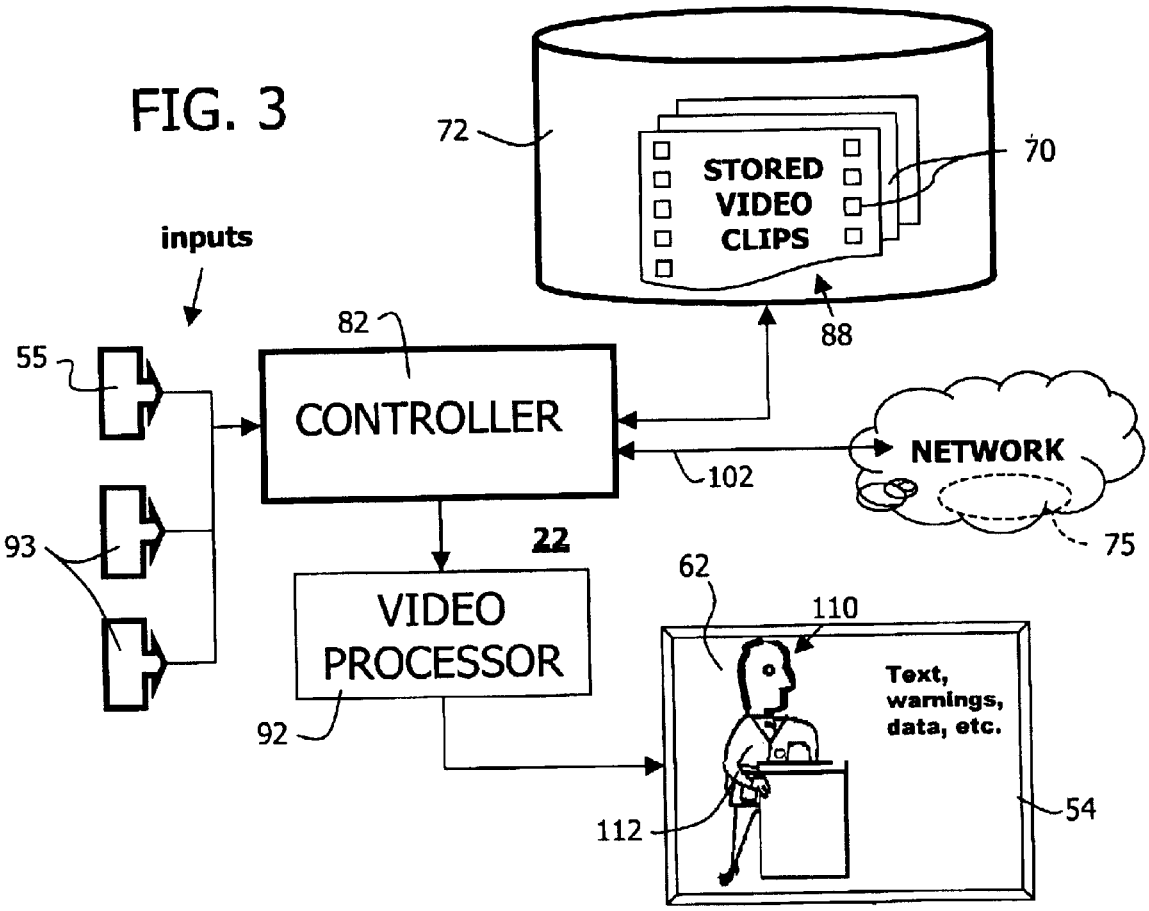
FIG. 3 is a block diagram showing elements of the invention according to an exemplary embodiment.

Referring to the block diagram of FIG. 3, the video clips 70 can be spooled from a data storage element 72 such as a hard drive or CD ROM drive. This can be, for example, information of general interest regarding the printer, promotional information, for example regarding other offerings of the printer manufacturer or promotional offerings for supplies such as paper or toner. The information also can be topical information such as news and weather reports, streamed from a remote data source or recently downloaded and spooled for playback. Preferably, a substantial part of the clips 70 relate to operations of the printer system 22.

The playback can be displayed on any of various forms of display apparatus such as liquid crystal or gas discharge display panels or a cathode-ray tube (CRT) display. Preferably the spooled demonstration playback is displayed on at least part of the same panel 52 that is used as the printer control panel. However it is also possible to have a supplemental image display apparatus and associated audio playback apparatus in addition or to instead of the main control panel 52.

Advantageously, one or more of the elements used to store and read out the motion picture clips as described can comprise the same sort of hardware and software elements that are used in general purpose and desktop computers, particularly with network access. These elements can include, for example, a central processor or controller 82 coupled to a hard drive for data storage and program storage. Part of this storage can contain the video storage area 72 that contains the clips 70, or it is also possible to provide a different memory for storage of video and/or audio data to be read out. This additional memory can be of the same type as used for regular operation of the controller (e.g., a hard drive) or can comprise one or more other memory types such as changeable media (e.g., a CD ROM drive) or volatile memory, or a combination thereof.

In the block diagram embodiment shown in FIG. 3, the printer apparatus is provided with a stored selection 88 of video clips 70 in a storage device 72. Each of the video clips 70 can contain a demonstration of at least one operation being performed on an exemplary printer that at least resembles the subject printer apparatus 22 and preferably is demonstrated on a printer apparatus that is identical. In the preferred arrangement, a media (video) clip processor 92 is operable to select among the video clips and to present a selected video clip on the visual display for assisting the human user in performing the operation on the printer apparatus.

The selection of clips 70 to be played can be made automatically by the controller 82 and queued to the clip processor 92. The selection preferably is based at least partly on the status of the apparatus as determined by various inputs to the controller. These inputs can include signals generated by sensors 93 that detect the condition of the physical parts of apparatus 22, such as whether particular paths are obstructed or doors ajar, etc. Additionally, the inputs can include user selection inputs 55, which are, for example, user selections entered using switches on the control panel 52. For example, the user can have the capability to select a programmed level of detail as desired, using switch inputs 55, or to select text plus video or to select more or less verbose explanations, to adjust an audio volume, etc. Advantageously, the selection can also be based on the status sensors 93, whereby the control can offer a demonstration of how to add paper or toner when supplies run low, how to clear a paper jam at a particular point in the paper feed path, how to avoid normal pitfalls such as avoiding inadvertent contact with a toner heater than might burn the user's fingers, etc.

As shown in FIG. 3, controller 82 is coupled to memory 72, contained in the printing apparatus 22 and wherein the video clips 70 are stored. The video clips can be organized by subject matter in various ways, for example dealing with regular functions such as selecting certain functional categories including maintaining supplies of media, e.g., paper and toner or other colorant, preventive maintenance steps, e.g., dealing with paper jams and problems, general interest clips explaining a printer function, e.g., "Did you known that . . . " information, or promotional clips, offers, news and entertainment.

In the embodiment of FIG. 3, the controller 82 of the apparatus 22 is coupled to a network 102. This connection to the network could be due to the printer 22 and its controller 82 being addressable units on a local area network (LAN) and/or could involve a Transport Control Protocol/Internet Protocol (TCP/IP) data communication path, for example. In a preferred arrangement, the apparatus 22 is coupled directly or indirectly to a network accessible to the worldwide web (the Internet) and the controller 82 of the printer apparatus 22 has TCP/IP access, for example to ftp (file transfer protocol) directories maintained by the printer manufacturer or by a service or an interest group. These files can advantageously contain stored compressed video clips that can be downloaded and stored in clip selection 88. This data communication path to a remote Internet site (shown generally as 75) could also connect to a site that maintains streaming video programs that can be accessed for playback, rather than being locally stored in clip selection 88. Streaming as opposed to local storage is particularly appropriate for clips that are only rarely selected. The controller can also store copies of any clips that are streamed, i.e., the controller can download the clips and store them as well as display them. In one arrangement, a selection of clips are preliminarily stored in a local memory device 72, in compressed format or the like, for playback on demand, and those clips can be updated or changed by obtaining physical access and loading a CD ROM or other mass memory element containing new clips to be added or to replace the clips that were originally provided.

Updates could be provided in any convenient way depending on the communication paths that are available to the printer. For example, the printer may have an email-like address whereby requests for media can be made and satisfied. A proprietary communications signally arrangement can be used, such as the Hewlett Packard WebJet Admin arrangement. The printer controller can be programmed to periodically access a website or ftp directory to search for pertinent downloads. Such communications can be entirely programmed and automatic or wholly or partly under user control, either by contemporaneous menu selections or by selecting among available defaults.

The video clips of concern according to this disclosure can be of any convenient length and data rate or file size, but preferably are short and to the point, containing demonstrations of actual maintenance operations being conducted on the same sort of printer apparatus 22. For some programming that might be played back, such as general introductions to a printer and its operation or perhaps even promotional materials, a higher resolution and data rate might be desirable. For a quick demonstration of how to open a particular access door or the like, a less complicated or extensive program might suffice for playback. Instead of a full video program streamed from a source or decompressed from a moving pictures experts group (MPEG), audio video internet (AVI), movie or video file (MOV) or other media format, the simple program could consist of several graphics interchange format (GIF) still images in a series of steps. These can be played back at a fast pace and/or in a loop as a brief animation demonstrating the necessary information. These and other video and audio video playback formats as well as audio only formats such as streaming to a browser, MPEG Audio Layer-3 (MP3) compression, Windows Media or RealAudio programs, or combinations of them can be employed.

More or less complicated and lengthy video clips could be provided and made selectable by controller 82. The more complicated or less-often played clips can be accessible by downloading or streaming from remote stores 75 as described, or a selection may be provided on a more proximate source such as a server coupled to an enterprise LAN or WAN of which the printer is an addressable node. Alternatively, the video clips can be provided in the memory provided in the printing apparatus originally. That memory can also contain media playback devices such as CD ROM drives, that can accept changeable playback media as required.

As discussed, the video clips preferably include demonstrations of operations associated with operation of the printing apparatus; however such demonstrations can be more or less elaborate and/or realistic. Preferably, the clips illustrate images of a human conducting an operation that is selected by programming or simply for information of interest to the user.

Relatively simpler illustrations can be combined or alternatively selectable with more realistic, elaborate, detailed or lengthy illustrations. A simple depiction could show a cartoon animation, or an motion picture clip showing all or part of an artificially generated avatar image. At least certain types of illustrations such as close-ups, advantageously can contain less than a full body image. For hand and finger manipulated parts, for example, at least an appendage 112 of an exemplary user 110 can be shown in the depicted program 62, in an act of performing the operation in question. Preferably that operation is one that is determined by the programming of the controller as necessary or desirable to operation of the printer, but could also be an operation that is selected by the user for informational purposes, or selected by the controller, e.g., randomly or as a sales promotion, news or other clip of interest.

In the illustrated embodiment, the printer 22 contains a printer controller 82, which contains a program memory (not shown) and is coupled to a plurality of sensors 55, 93, operative to couple status information and user selections to the printer controller 82. The printer controller is operable to queue the video clip processor 92 to select among the video clips 70 to demonstrate operations selected as a function of the status information. The printer controller can be a special purpose programmed microprocessor system, but alternatively, the printer controller can comprise a standard PC motherboard with a processor and peripherals including standard parallel, serial, USB and similar interfaces, and including a display driver that controls the output display in at least certain modes of operation of the controller.

The various sensor inputs 93 and switch or other user-selection inputs 55 permit the controller 82 to assess the status of sensed conditions and also to receive user inputs. The status information sensed can be status digital signals such as the state of an optical path across a paper feed path (clear or blocked) or a door panel (open/closed) or other moveable part. The sensed information can be encoded by a signal as analog or digital level, e.g., for sensing a temperature or for maintaining a count. The user inputs can be selections made among alternative positions of one or more switches or movable controls, etc.

The status information can represent at least one of a state of a necessary supply such as a paper or marking agent supply. The status information can include a sensed operational condition of an element of the printer apparatus, such as an obstructed condition of a part of the printer apparatus. The video clip demonstrates a respective one of adding to the supply, altering the operational condition, clearing the obstructed condition or otherwise instructing the user specifically in some operation associated with the printer, namely by demonstrating such acts being carried out.

In the embodiment in which the controller processes the video clip data, for example to decompress and read out a program stored in a compressed video clip or a succession of still shots forming an animation, the processor preferably comprises a video clip driver. The driver can comprise hardware and/or software for reading out a visible presentation from a stored video file.

The invention having been disclosed, additional variations will become apparent to persons skilled in the art, in view of this disclosure. It is to be understood that the present invention is by no means limited only to the particular constructions herein disclosed and shown in the drawings, but also comprises any modifications or equivalents within the scope of the claims.

What is claimed is:

1. A printer system comprising:

a printer apparatus, having a printer mechanism for applying markings to sheet material and a sheet handler associated therewith, wherein at least certain operations require steps to be performed by a human user on the printer apparatus;

at least one control panel interface, the control panel interface having a visual display capable of reproducing a video presentation;

a stored selection of media clips, each of the media clips containing at least a partial demonstration of information for performing at least one operation on an exemplary printer that resembles said printer apparatus, and wherein the media clips contain at least two selectable media clips for said at least one operation, wherein the selectable media clips are adapted for distinct levels of at least one information detail and differences of user capability;

a media clip processor operable to select among the media clips, including selecting among said at least two selectable media clips for said at least one operation, and to present a selected media clip on the visual display for assisting the human user in performing said operation on the printer apparatus according to said distinct levels of at least one of information detail and differences of user capability.

2. The printer system of claim 1, wherein the media clip contains at least one of a video clip, audio clip and audio-video clip, containing a demonstration of said operation.

3. The printer system of claim 2, wherein the media clip is digitally encoded.

4. The printer system of claim 3, further comprising a controller coupled to a data network for storage of at least part of the media clip in a memory.

5. The printer system of claim 1, further comprising a controller coupled to a memory contained in the printing apparatus and wherein the memory stores a selection of said media clips.

6. The printer system of claim 5, wherein the controller is coupled to a data network for access to a plurality of said media clips, and wherein the media clips are downloaded from the network to the media clip processor on demand.

7. The printer system of claim 5, wherein the controller is coupled to a data network for access to a plurality of said media clips, and wherein the media clips are streamed from the network to the visual display.

8. The printer system of claim 1, wherein at least some of the media clips contain at least a still visible depiction of at least an appendage of at least one exemplary user in an act of performing said operation.

9. The printer system of claim 8, wherein the exemplary user depicted in the clips is one of a human model and an avatar.

10. The printer system of claim 1, further comprising a printer controller coupled to a program memory and coupled to a plurality of sensors operative to couple status information to the printer controller, and wherein the printer controller is operable to queue the media clip processor to select among the media clips to demonstrate operations selected as a function of the status information.

11. The printer system of claim 10, wherein the status information represents at least one of a state of a necessary supply of one of paper and marking agent, an operational condition of an element of the printer apparatus, and an obstructed condition of a part of the printer apparatus, and the media clip demonstrates a respective one of adding to the supply, altering the operational condition and clearing the obstructed condition.

12. The printer system of claim 1, wherein the media clip processor comprises a video driver for reading out a visible presentation from a stored video file.

13. The printer system of claim 12, wherein the stored video file contains compressed digital video data.

14. The printer system of claim 1, further comprising a printer controller coupled to a program memory and coupled to a plurality of sensors operative to couple status information to the printer controller, wherein the printer controller is operable to queue the media clip processor to select among the media clips to demonstrate operations selected as a function of the status information, and wherein the status information at least partly determines a level of detail and a level of user capability used by the controller to select among the at least two selectable media clips for said at least one operation.

15. A method for operating a printer system requiring occasional manual operations to maintain operation of the printer system, comprising:

storing a selection of media clips including at least one demonstration of at least one of said manual operations;

selecting a media clip from said selection of media clips upon occurrence of a predetermined condition related to the operations;

displaying the media clip on a display device for instructing a user in carrying out said manual operations;

wherein the selecting and displaying steps are effected according to a programmed operation that includes selecting said media clip from among at least two alternatives stored in the selection of media clips, wherein said at least two alternatives are each associated with said predetermined condition, and wherein the alternatives are directed to different levels of user experience and capability.

16. The method of claim 15, wherein the media clips are stored locally on the printer system and comprise digitally encoded clips of at least one of video, audio and audio-visual depictions of a person effecting said at least one of said manual operations, on an apparatus that at least resembles said printer system.

17. The method of claim 15, further comprising sensing at least one of a status condition of the printer system and a user's input, and wherein said selecting of the media clip is made at least partly as a function of one of the status condition and the user's input.

18. The method of claim 17, further comprising determining which of the at least two alternatives shall be selected and displayed for the given occurrence, and wherein a level of said user experience and capability is sensed by the controller from said at least one of the status condition and the user's input.

19. The method of claim 15, further comprising making the selection of clips available to the printer system over one of a network and by use of a portable storage medium.

20. The method of claim 19, wherein the selections comprise at least one of demonstration of clearing of a jammed condition, demonstration of adding to a supply of media, demonstration of deploying an optional feature, demonstration of installing an add-on, promotional information, and entertainment.

21. The method of claim 15, wherein the printer system comprises a controller and the selection of clips is at least partly encoded digitally, and wherein said selecting and displaying steps are effected by the controller according to programmed operation including determining which of the at least two alternatives for said predetermined condition shall be selected and displayed in a given occurrence of said predetermined condition.

* * * * *